US007413455B2

(12) United States Patent
Hughes et al.

(10) Patent No.: US 7,413,455 B2
(45) Date of Patent: Aug. 19, 2008

(54) ELECTRICAL CONNECTOR ASSEMBLY

(75) Inventors: David Charles Hughes, Rubicon, WI (US); Allen Leroy Johnson, Mukwonago, WI (US); Brian Todd Steinbrecher, Brookfield, WI (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/035,410

(22) Filed: Jan. 14, 2005

(65) Prior Publication Data

US 2006/0160388 A1 Jul. 20, 2006

(51) Int. Cl.
*H01R 13/53* (2006.01)

(52) U.S. Cl. ..... 439/187; 439/89

(58) Field of Classification Search ..... 439/181, 439/183, 921, 89, 86, 186, 187
See application file for complete search history.

(56) References Cited

U.S. PATENT DOCUMENTS 3,509,516 A * 4/1970 Phillips ..... 439/921
4,029,380 A * 6/1977 Yonkers ..... 439/183
5,655,921 A * 8/1997 Makal et al. ..... 439/921
5,846,093 A * 12/1998 Muench et al. ..... 439/921
6,042,407 A * 3/2000 Scull et al. ..... 439/181
6,843,685 B1 1/2005 Borgstrom et al.

OTHER PUBLICATIONS

PCT International Search Report (PCT/US06/00815) dated Jun. 16, 2006 (3 pages).
PCT Written Opinion of the International Searching Authority (PCT/US06/00815) dated Jun. 16, 2006 (6 pages).

* cited by examiner

*Primary Examiner*—Felix O. Figueroa
(74) *Attorney, Agent, or Firm*—Fish & Richardson P.C.

(57) ABSTRACT

In one aspect, an electrical connector assembly can be removably coupled to a second electrical connector assembly. The electrical connector assembly includes an elastomeric insulative layer and a rigid conductive sleeve disposed within the insulative layer. One or both of the rigid conductive sleeve and the insulative layer have interior surfaces that define an opening. A conductive contact is disposed within the opening and a conductive or semi-conductive exterior layer at least partially covers the insulative layer. The rigid conductive sleeve is configured to act as a voltage shield and the conductive or semi-conductive exterior layer is configured to act as a ground shield.

20 Claims, 8 Drawing Sheets

ELECTRICAL CONNECTOR ASSEMBLY

TECHNICAL FIELD

This description relates to an electrical connector assembly.

BACKGROUND

Sources of high-voltage electrical energy, such as transformers, can be interconnected using separable electrical connectors. These connectors typically include a male connector and a female connector that can be connected and disconnected from each other. A male connector typically includes an electrically insulative elastomeric housing, a conductive or semi-conductive elastomeric insert received within the housing and that defines a bore, and a male conductive probe that is disposed in the bore. A female connector typically includes an electrically insulative, elastomeric bushing that defines an interior bore that receives a cylindrical conductive contact. Typically, the female connector bushing is received within the bore in the male connector while the male probe is received within the conductive insert in the bushing to make an electrical connection. Examples of such connectors are described, for example, in U.S. Pat. No. 5,655,921, titled "Loadbreak Separable Connector," the entirety of which is incorporated by reference.

SUMMARY

In one aspect, an electrical connector assembly can be removably coupled to a second electrical connector assembly. The electrical connector assembly includes an elastomeric insulative layer and a rigid conductive sleeve disposed within the insulative layer. One or both of the rigid conductive sleeve and the insulative layer have interior surfaces that define an opening. A conductive contact is disposed within the opening and a conductive or semi-conductive exterior layer at least partially covers the insulative layer. The rigid conductive sleeve is configured to act as a voltage shield and the conductive or semi-conductive exterior layer is configured to act as a ground shield.

Implementations may include one or more of the following features. For example, the insulative layer may cover at least a portion of an interior surface of the rigid conductive sleeve. The rigid conductive sleeve may include a conductive metal or plastic. The rigid conductive sleeve may be electrically coupled to the conductive contact. The conductive contact may include a conductive probe configured to be received in a second conductive contact of the second electrical connector assembly. The opening may be configured to receive the second connector assembly while the conductive probe is received in the second conductive contact of the second connector assembly.

The rigid conductive sleeve may be configured to conduct heat away from a connection between the conductive contact and the second conductive contact of the second electrical connector assembly, to provide mechanical strength (e.g., to protect the connection), and to act as a voltage shield around the connection. The rigid conductive sleeve may simplify manufacture of the electrical connector assembly.

In another aspect, an electrical connector assembly includes a housing having a first end portion with a first electrical connector and a second end portion with a second electrical connector. The first electrical connector is configured to be removably coupled to a third electrical connector and the second electrical connector is configured to be removably coupled to a fourth electrical connector. The first electrical connector includes a first elastomeric insulative layer and a first rigid conductive sleeve disposed within the first insulative layer. One or both of the first rigid conductive sleeve and the first insulative layer have interior surfaces that define a first opening. A first conductive contact is disposed within the first opening and a first conductive or semi-conductive exterior layer at least partially covers the first insulative layer. The first rigid conductive sleeve is configured to act as a voltage shield and the first conductive or semi-conductive exterior layer is configured to act as a ground shield.

Implementations may include one or more of the following features. For example, the first conductive contact may include a first conductive probe that is configured to be received in a third conductive contact of the third connector. The first opening may be configured to receive the third electrical connector while the first conductive probe is received in the third conductive contact. The second electrical connector may include a second conductive contact configured to receive a conductive probe of the fourth electrical connector. The second electrical connector may include a second elastomeric insulative layer and a second rigid conductive sleeve disposed within the second insulative layer. One or both of the second rigid conductive sleeve and the second insulative layer may have interior surfaces that define a second opening. A second conductive contact may be disposed within the second opening. A second conductive or semi-conductive exterior layer may at least partially cover the second insulative layer, The second rigid conductive sleeve may be configured to act as a voltage shield and the second conductive or semi-conductive exterior layer may be configured to act as a ground shield.

In another aspect, manufacturing an electrical connector assembly may include arranging a conductive or semi-conductive exterior layer in a mold, placing a rigid conductive sleeve in the mold with a space between the sleeve and the exterior shell, and filling the space in the mold with an elastomeric insulative material.

Implementations may include one or more of the following features. One or both of the rigid conductive sleeve and the insulative material may have interior surfaces that define an opening. A conductive contact may be attached to the rigid conductive sleeve such that the conductive contact is disposed in the opening. The conductive contact may include a probe.

The details of one or more implementations are set forth in the accompanying drawings and the description below. Other features will be apparent from the description and drawings, and from the claims.

DETAILED DESCRIPTION

A first electrical connector assembly can be removably coupled to a second electrical connector assembly. The first electrical connector assembly includes a housing, a rigid conductive sleeve received within the housing and defining an opening, and a first electrical contact disposed within the opening. The second electrical connector assembly includes a bushing receivable in the opening and a second electrical contact that mates with the first electrical contact to make an electrical connection. The rigid conductive sleeve acts as a heat conductor that reduces the heat load at the interface between the first and second electrical contacts, provides mechanical strength to protect the connection between the first and second electrical contacts, and serves as a voltage shield around the electrical connection between the first and second electrical contacts. The rigid conductive sleeve also simplifies the manufacture of the first electrical connector assembly.

Figure 1:
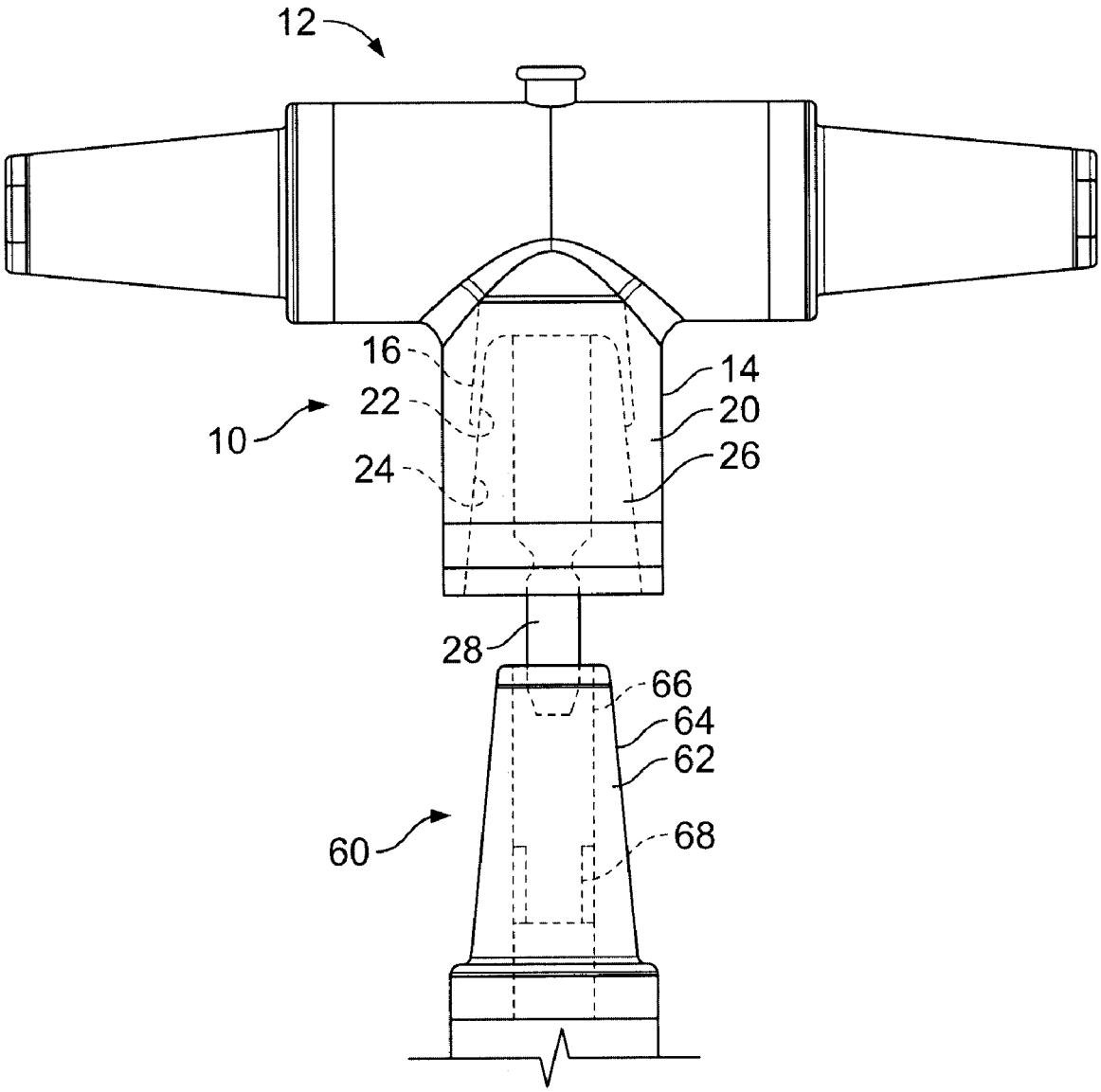
FIG. 1 is a side view of a T-shaped assembly that includes a male electrical connector assembly being coupled to a female electrical connector assembly.

Referring to FIG. 1, in one implementation, a male electrical connector assembly 10 connected to a first piece of electrical equipment (not shown) may be removably coupled to a female electrical connector assembly 60 that is connected to another piece of electrical equipment (not shown). The male electrical connector assembly 10 includes an elastomeric insulative housing 20 and a rigid conductive sleeve 16 received within the insulative housing 20. The insulative housing 20 is at least partially covered by a conductive or semi-conductive exterior layer 14 that is configured to act as a ground shield. Rigid conductive sleeve 16 and insulative layer 20 have interior surfaces 22 and 24, respectively, that define a conical opening 26. Disposed within the conical opening 26 is a male conductive contact 28 in the form of a probe. The female connector assembly 60 includes an electrically insulative, elastomeric bushing 62 with a conical exterior surface 64 and an interior bore 66 that receives a female conductive contact 68 in the form of a cylindrical conductive sleeve. Male conductive probe 28 is receivable inside female conductive sleeve 68 to make an electrical connection, while bushing 62 is received inside conical opening 26.

Figure 2:
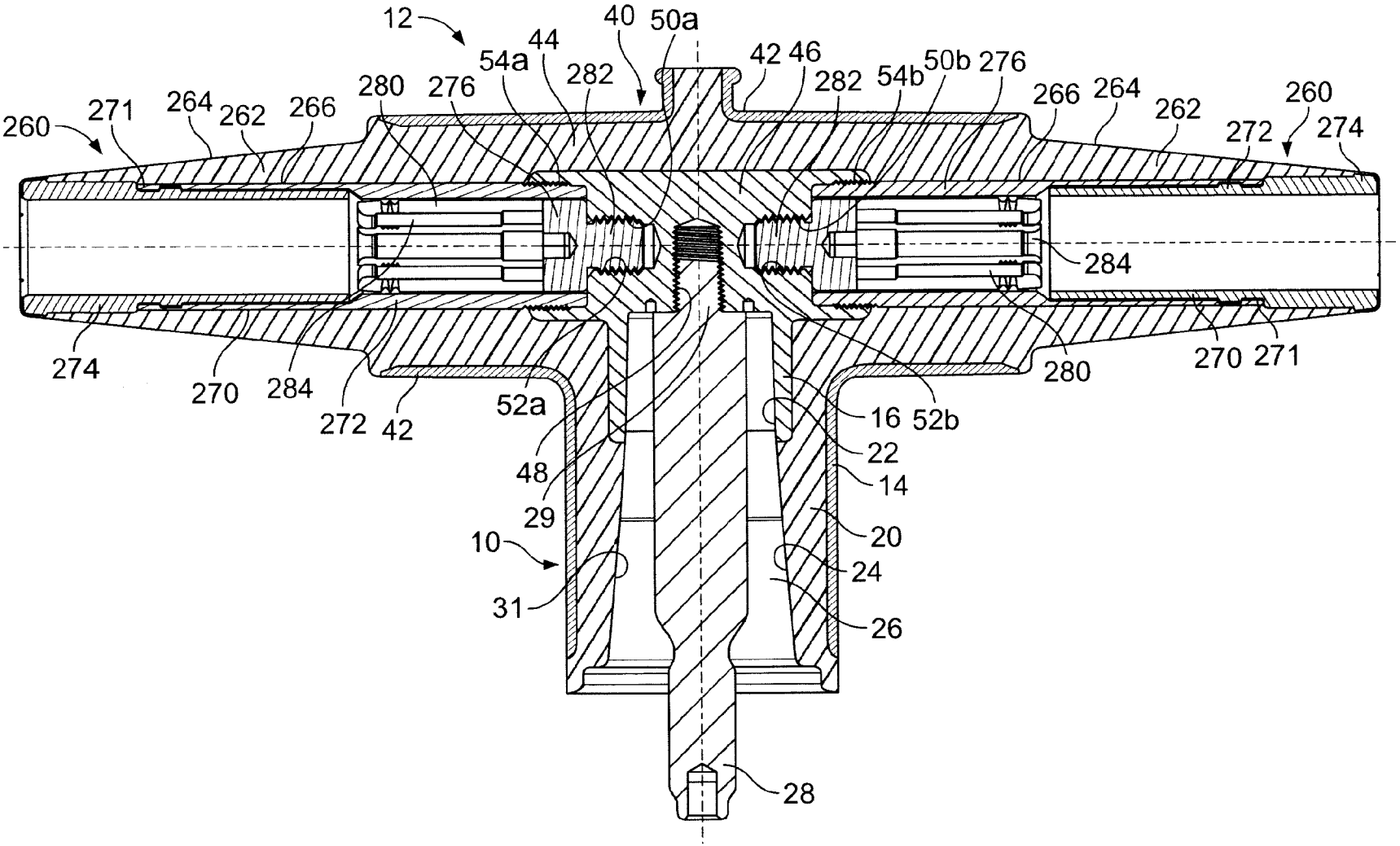
FIG. 2 is a cross-sectional view of the T-shaped housing shown in FIG. 1.

Referring also to FIG. 2, male connector assembly 10 is part of a T-shaped assembly 12 that also includes two female electrical connector assemblies 260 that are electrically connected to male connector assembly 10 to permit connection to more than one piece of electrical equipment (not shown). Each female connector assembly 260 includes an electrically insulative, elastomeric bushing 262 with a conical exterior surface 264 and a generally cylindrical interior bore 266. Bore 266 receives a sleeve 270 that includes a conductive portion 272 and an insulative portion 274. Received in sleeve 270 is a conductive finger contact assembly 280 having a set of conductive finger contacts 284. Each female connector assembly 260 can be removably coupled to other electrical equipment that has a corresponding male connector assembly, such as, for example, equipment that has a male connector assembly that is analogous to male connector assembly 10.

Male connector assembly 10 and female connector assemblies 260 are joined at a middle portion 40 of T-shaped assembly 12. Middle portion 40 includes an elastomeric electrically insulative layer 44, a rigid electrically conductive body 46 disposed within insulative layer 44, and an electrically conductive outer layer 42 that at least partially covers insulative layer 44. Portions of insulative layer 44 extend from middle portion 40 to form insulative housing 20 of male connector assembly 10 and to form insulative bushings 262 of female connector assemblies 260. A portion of electrically conductive outer layer 42 extends from middle portion 40 to form the conductive exterior layer 14 of male connector assembly 10.

A portion of body 46 extends from middle portion 40 to form the rigid conductive sleeve 16 of male connector assembly 10. Body 46 includes a first threaded bore 48 that is configured to receive a threaded base 29 of male conductive probe 28. Body 46 also includes second and third bores 50*a* and 50*b* that include respective narrow threaded portions 52*a* and 52*b* and respective wide threaded portions 54*a* and 54*b*. Each of narrow threaded portions 52*a* and 52*b* is configured to receive a threaded base portion 282 of a finger contact assembly 280. Each of wide threaded portions 54*a* and 54*b* is configured to receive a threaded base portion 276 of a sleeve 270.

Rigid conductive sleeve 16 is composed of a rigid conductive material, such as a metal (e.g., aluminum or copper) or a conductive plastic. Because rigid conductive sleeve 16 is electrically coupled to conductive probe 28 through body 46, rigid sleeve 16 is kept at the same voltage potential as probe 28, and, thus, functions as a voltage shield around probe 28. Conductive probe 28 and finger contact assemblies 280 are composed of similar rigid or semi-rigid conductive materials. Conductive exterior layers 14 and 42 are composed of an elastomeric conductive or semi-conductive material, such as a conductive rubber, and are kept at ground potential to act as a ground shield. Insulative housing 20, insulative layer 44, and insulative bushing 262 are composed of an elastomeric non-conductive material, such as rubber, to insulate the rigid conductive sleeve 16, the male conductive probe 28, and the female conductive contact 68 from the exterior layers and to provide a tight fit between the female and male connectors.

Figure 3:
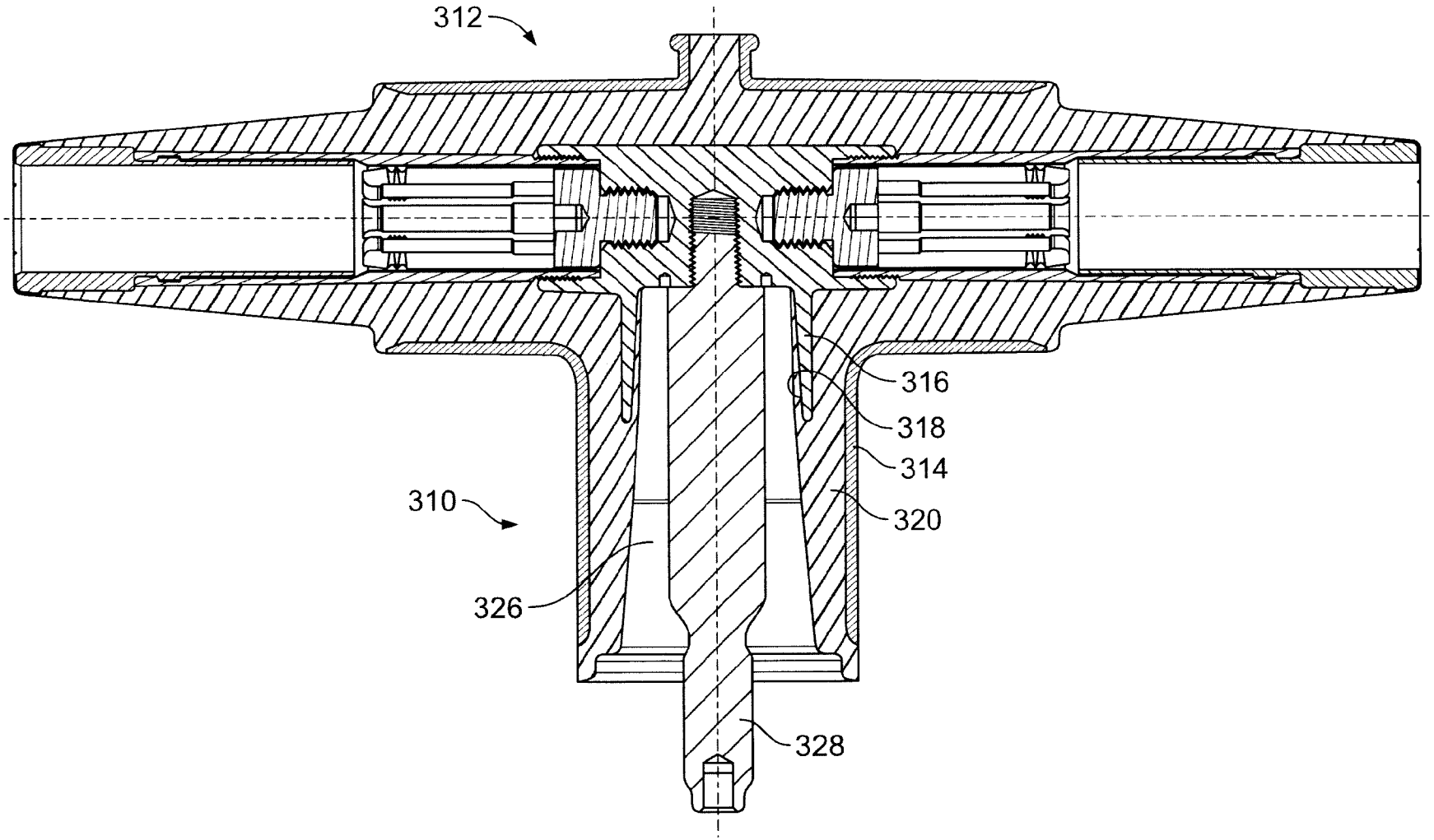
FIG. 3 is a cross-sectional view of another implementation of an electrical connector assembly.

Referring to FIG. 3, in an alternative implementation, a T-shaped connector assembly 312 includes a male connector assembly 310. Male connector 310 includes an elastomeric insulative layer 320, a rigid conductive sleeve 316 received within the insulative layer 320, and a conductive or semi-conductive exterior ground shield layer 314 that at least partially covers insulative housing 320. Male connector 310 defines a conical opening 326 inside of which is disposed a male conductive contact 328 in the form of a probe. Male connector 310 differs from male connector 10 in that insulative layer 320 completely covers an interior surface 318 of rigid conductive sleeve 316 and defines conical opening 326. The additional insulation that covers interior surface 318 of rigid sleeve 316 reduces the risk of flashover when the male connector 310 is separated from a corresponding female connector, as described, for example, in the above-mentioned U.S. Pat. No. 5,655,921.

Figure 4A:
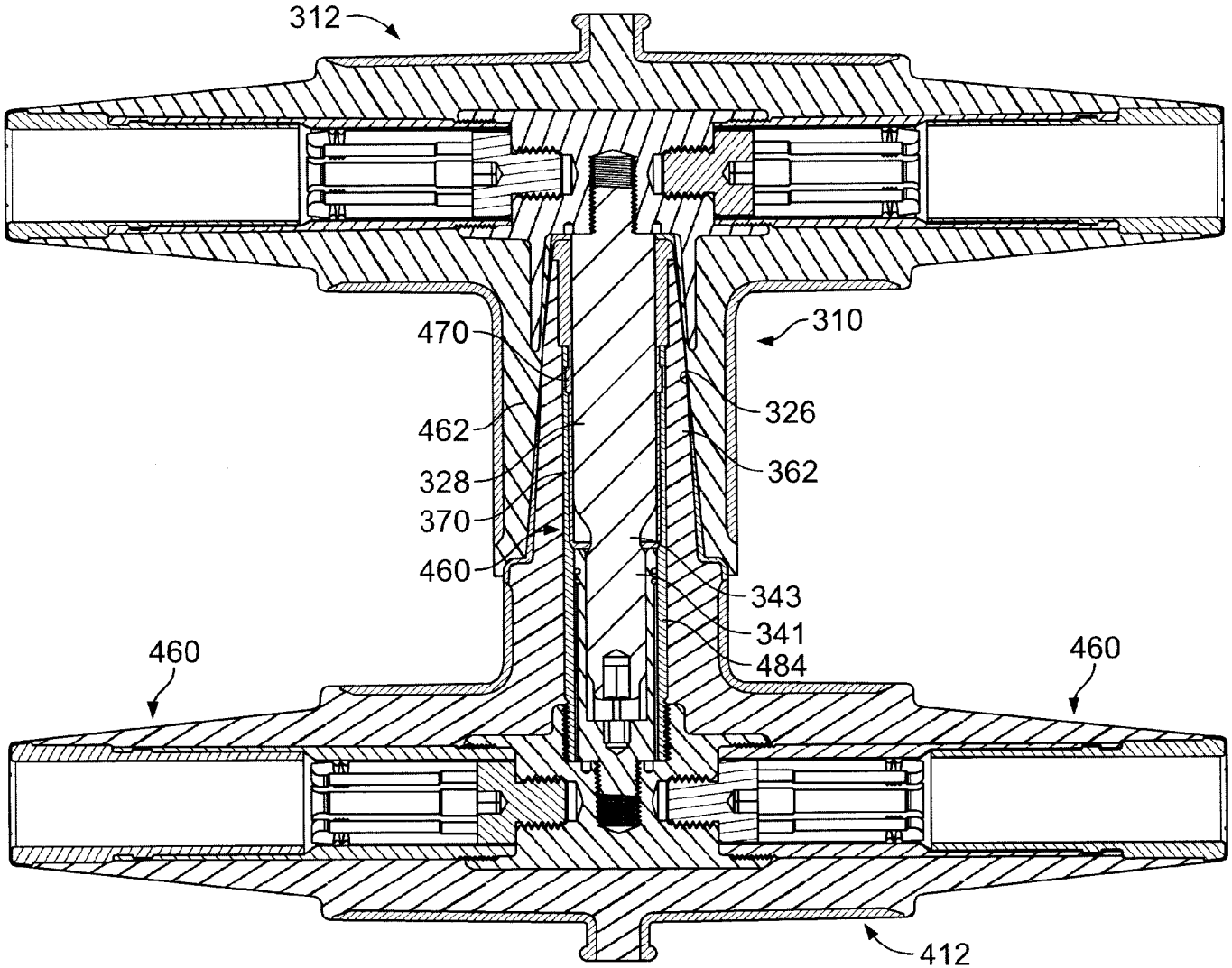
FIG. 4A is a cross-sectional view of the male electrical connector assembly of FIG. 3 coupled to a female electrical connector assembly.

FIG. 4A shows male connector assembly 310 of the T-shaped assembly 312 of FIG. 3 coupled to a second T-shaped assembly 412 that has three female connectors 460 that are analogous to the female connectors 260 described above. Probe 328 of male connector 310 is received in a finger contact assembly 480 received in a cylindrical sleeve 470 of female connector 460, while a conical bushing 462 of female connector 460 is received in conical opening 326 of male connector 310.

Figure 4B:
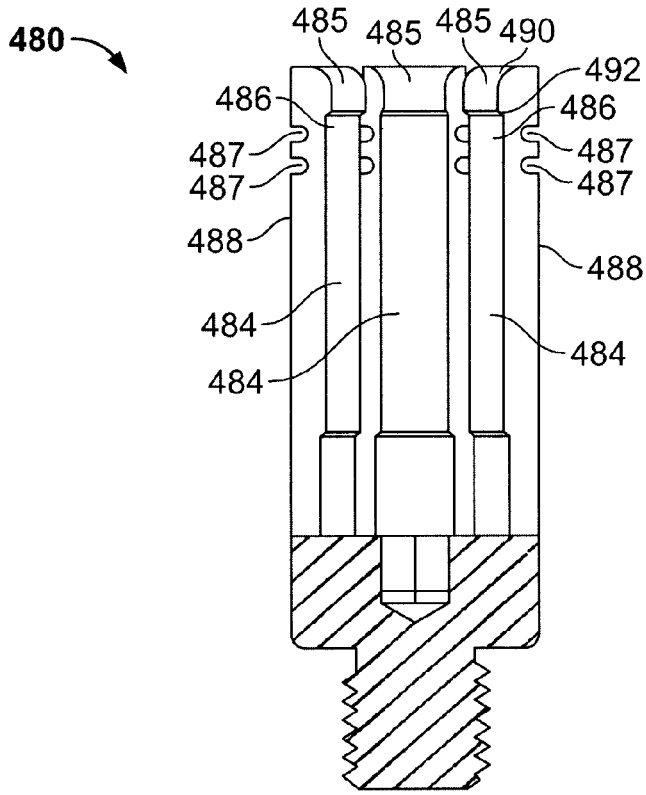
FIG. 4B is a side view of a finger contact assembly of the female electrical connector assembly of FIG. 4A.
Figure 4C:
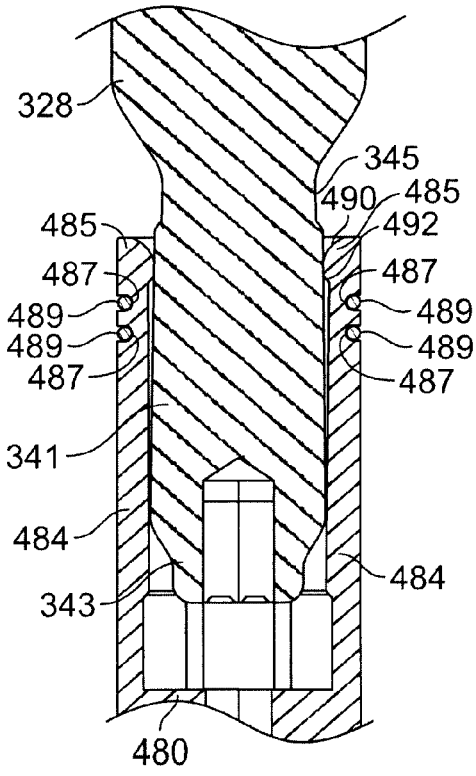
FIGS. 4C and 4D are cross-sectional detailed views of a male connector probe of the male electrical connector coupled to the female contact assembly of the female electrical connector assembly of FIG. 4A.
Figure 4D:
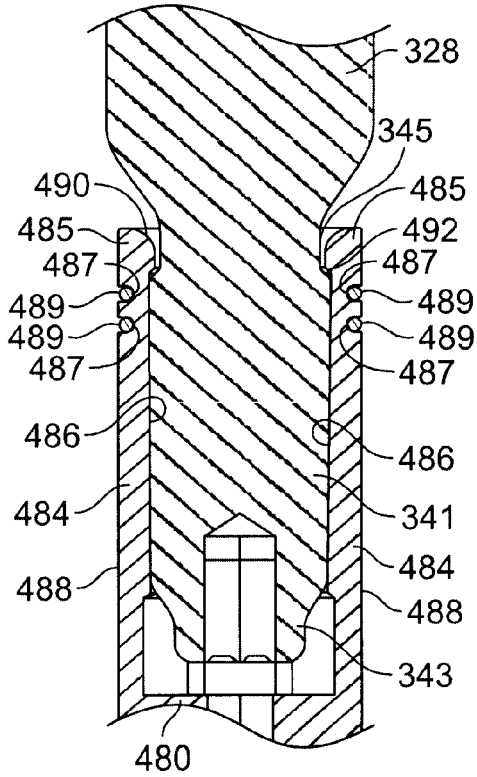

Referring also to FIGS. 4B, 4C, and 4D, finger contact assembly 480 includes a cylindrical grouping of finger contacts 484. Each finger contact 484 includes a projection 485 projecting from an inner surface 486 and a pair of recessed grooves 487 defined by an external surface 488 of the finger contact 484. Each recessed groove 487 receives an expandable retention spring 489 that biases the finger contact 484 towards the inner surface 486 of the finger contact 484.

The probe 328 includes a narrowed end portion 341 with a tapered tip 343 that facilitates inserting the probe 328 into the cylindrical grouping of finger contacts 484 by slightly separating the finger contacts 484 (FIG. 4C). The probe 328 also includes an annular groove 345 that provides a contact point for the projections 485 to interlock with the probe 328 and to form an electrical connection between the probe 328 and the finger contacts 484 when the probe 428 has been fully inserted into the cylindrical grouping of finger contacts 484 (FIG. 4D).

Each projection 485 is formed with a rounded face 490 and an angled ridge 492 that is sloped approximately close to perpendicular to inner surface 486, at a steeper angle than rounded face 490. The rounded face 490 allows probe 328 to slide into the cylindrical grouping of finger contacts 484 with minimal resistance and reduced friction. The steep angle of ridge 492 causes projections 485 to be reversibly locked in annular groove 345 of probe 328, such that the force required to unlatch the probe 328 from the finger contact assembly 480 is greater than the force required to latch the probe 328. In one particular implementation, the mating of the probe 328 and the plurality of finger contacts 480 produces an audible click, ring, or other audible notification, such as, for example, a click loud enough to be heard by the unaided ear from a distance of at least four feet.

Figure 5:
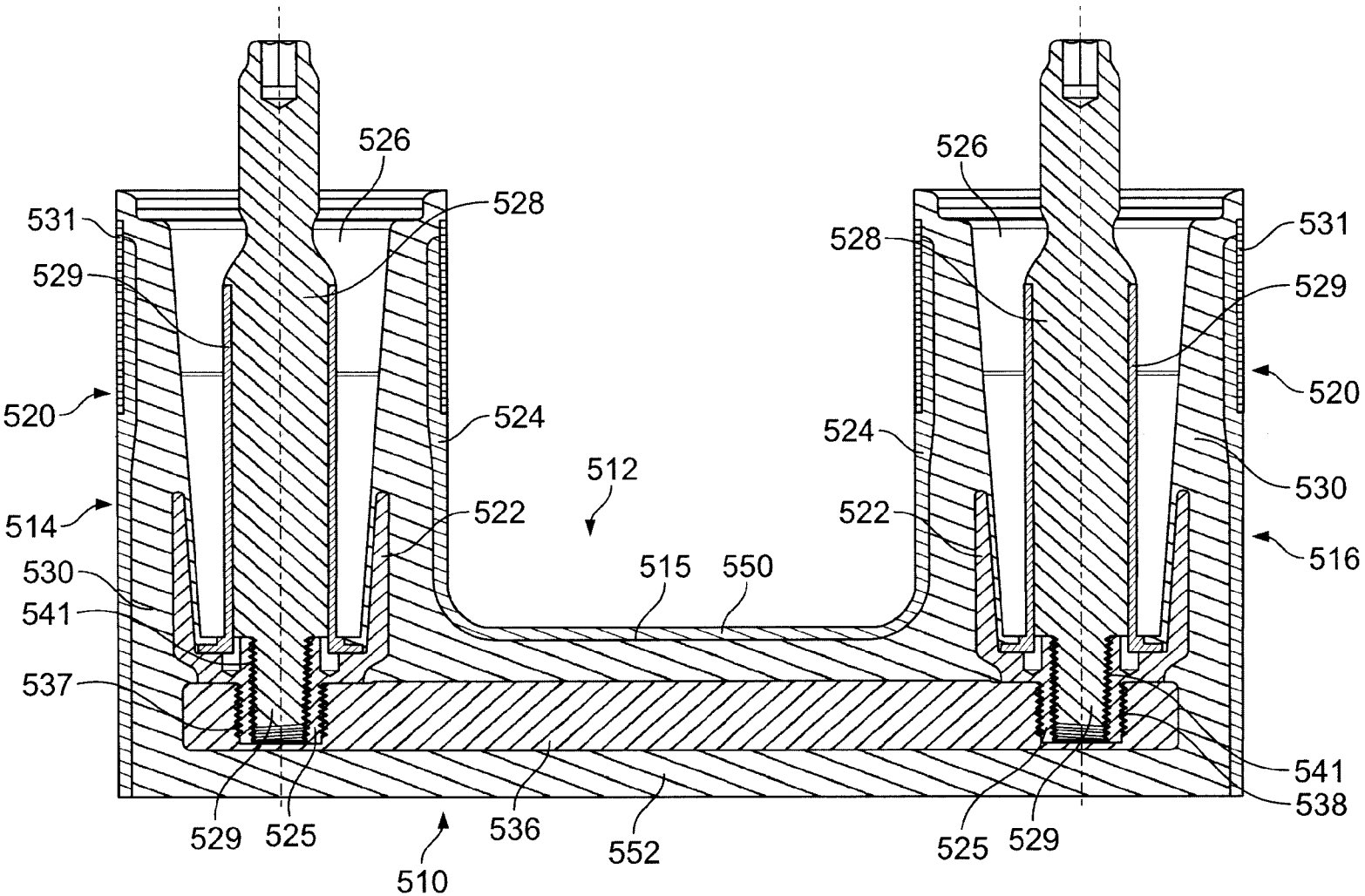
FIGS. 5 and 6 are cross-sectional views of other implementations of electrical connector assemblies.

Referring to FIG. 5, in another implementation, a U-shaped connector assembly 510 includes a housing 512 with a middle portion 515 and a first end portion 514 and a second end portion 516 extending from the middle portion 515 generally in a U-shape. Middle portion 515 includes an electrically insulative layer 552, an electrically conductive bar 536 within insulative layer 552, and an electrically conductive outer layer 550 covering the insulative layer 552. Conductive bar 536 defines a first threaded bore 537 adjacent to first end portion 514 and a second threaded bore 538 adjacent to second end portion 516.

Each of first and second end portions 514 and 516 includes a male electrical connector 520. Male electrical connector 520 includes an elastomeric insulative layer 530, a rigid conductive sleeve 522 received within the insulative layer 530, and a conductive or semi-conductive exterior ground shield layer 524 that at least partially covers insulative layer 530. Insulative layer 530 defines a conical opening 526 inside of which is disposed a male conductive contact 528 in the form of a probe. Each rigid conductive sleeve 522 includes an externally threaded base portion 525 that is received in threaded bores 537 and 538, and an internally threaded bore 541 that receives a threaded base portion 529 of conductive probe 528. The male electrical connector 520 can be coupled to a corresponding female connector, such as one of the female electrical connectors 60, 260, or 460 described above, to form an electrical connection. A portion of probe 528 is covered with a layer of non-conductive material 529 and a portion of ground shield layer 524 is covered with a layer of non-conductive material 531 to reduce the risk of flashover when male probe 528 is removed from a corresponding female electrical connector.

Figure 6:
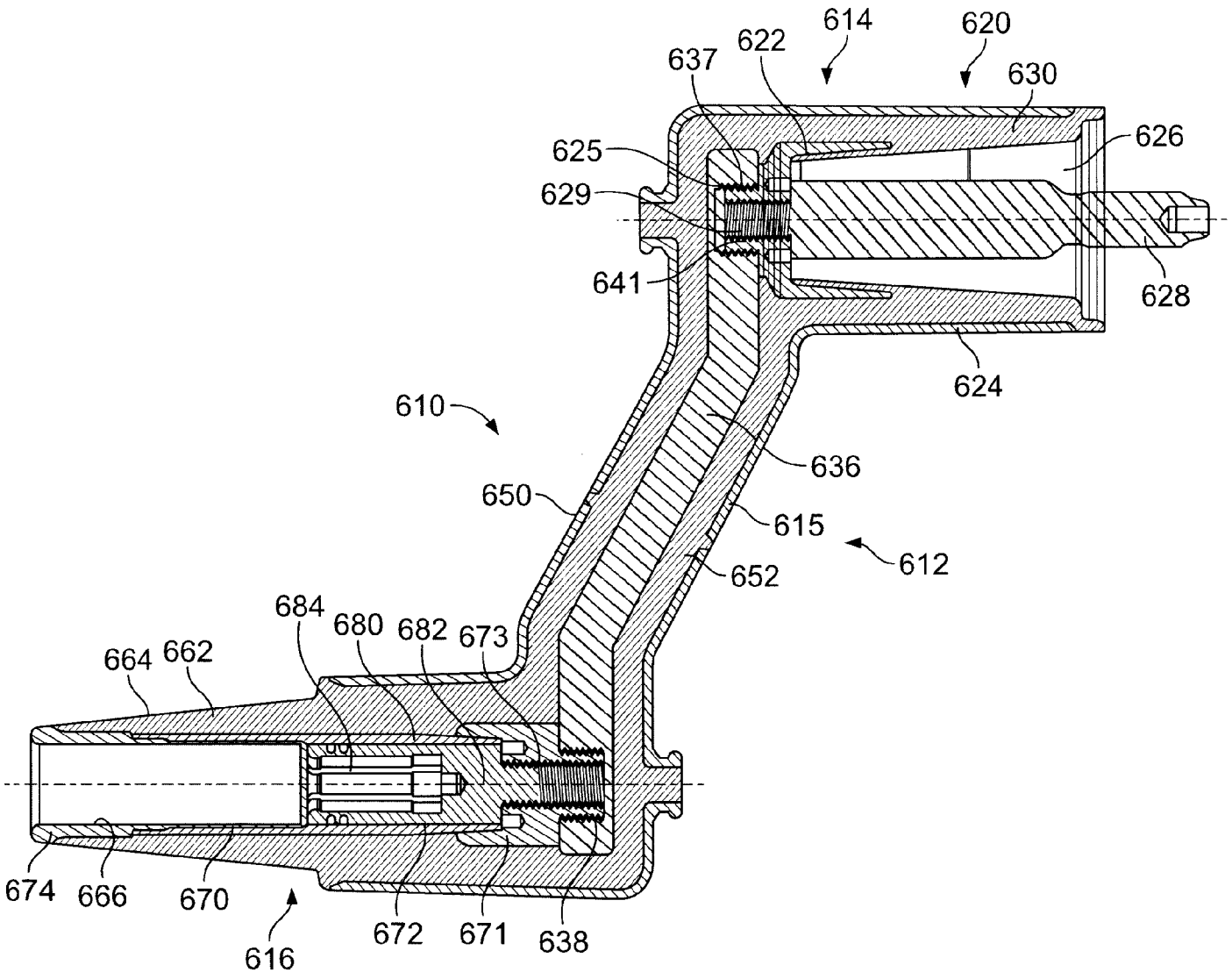

Referring to FIG. 6, in another implementation, a Z-shaped connector assembly 610 includes a housing 612 with a middle portion 615 and a first end portion 614 and a second end portion 616 extending from the middle portion 615 generally in a Z-shape. Middle portion 615 includes an electrically insulative layer 652, an electrically conductive bar 636 embedded within insulative layer 652, and an outer conductive layer 650 that covers the insulative layer 652. Conductive bar 636 defines a first threaded bore 637 adjacent to first end portion 614 and a second threaded bore 638 adjacent to second end portion 616.

First end portion 614 includes a male electrical connector 620 that is analogous to the male connector 310, described above. Male electrical connector 620 includes an elastomeric insulative layer 630, a rigid conductive sleeve 622 received within the insulative layer 630, and a conductive or semi-conductive exterior ground shield layer 624 that at least partially covers insulative layer 630. Insulative layer 630 defines a conical opening 626 inside of which is disposed a male conductive contact 628 in the form of a male conductive probe 628. Rigid conductive sleeve 622 includes an externally threaded base portion 625 that is received in threaded bore 637, and an internally threaded bore 641 that receives a threaded base portion 629 of conductive probe 628. The male electrical connector 620 can be coupled to a corresponding female electrical connector, such as one of female electrical connectors 60, 260, 460, or 560, described above, to form an electrical connection.

Second end portion 616 includes a female electrical connector 660 with an elastomeric electrically insulative bushing 662 that extends from insulative layer 652 of middle portion 615. Insulative bushing 662 has a generally conical exterior surface 664 and defines a generally cylindrical interior bore 666. Received within interior bore 666 is a cylindrical sleeve 670 with an insulative portion 674, a conductive portion 672, and an externally threaded base portion 671 that is received within threaded bore 638 of conductive bar 636. Disposed within sleeve 670 is a finger contact assembly 680 that includes a threaded base 682 received within a threaded bore 673 in base portion 671 of sleeve 670. Finger contact assembly 680 also includes a set of finger contacts 684 that extend into sleeve 670. Female connector 660 can be coupled to a corresponding male connector, such as one of male connectors 10, 320, 420, 520, or 620 described above, to form an electrical connection.

Figure 7:
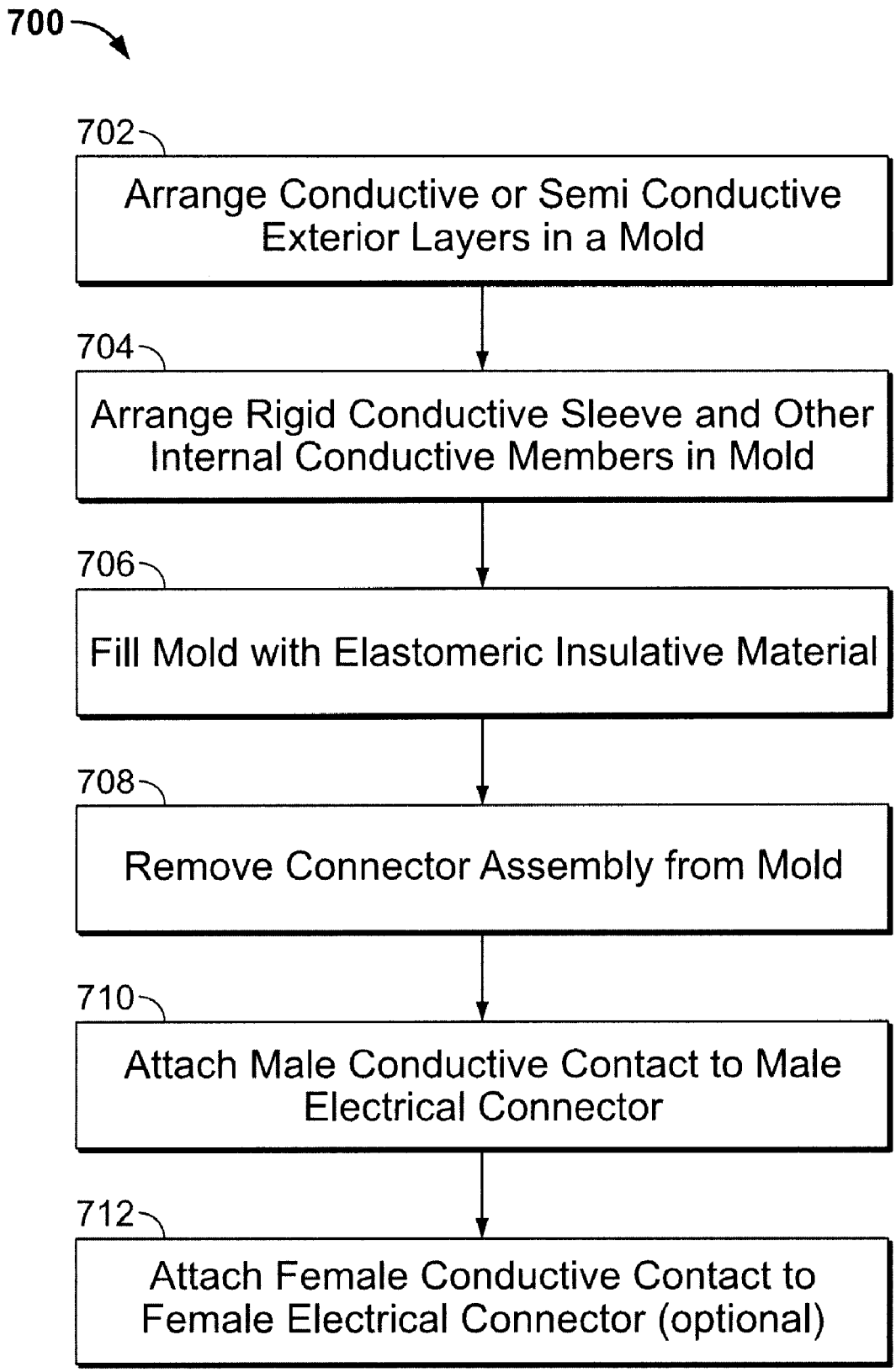
FIG. 7 is a flow chart showing a method of manufacturing an electrical connector assembly.

Referring to FIG. 7, a flow chart shows a method 700 for manufacturing one of the above-described electrical connector assemblies, such as the T-shaped connector assembly shown in FIGS. 1 and 2. First, the conductive or semi-conductive exterior layers are arranged in a mold (702). Next, the rigid conductive sleeve of the male electrical connector and any other internal conductive member are arranged into the mold with a space between these elements and the exterior layers (704). The mold is then filled, such as by injection molding, with an elastomeric, insulative material to form the insulative layer (706). Once the insulative layer has solidified, the connector assembly is removed from the mold (708). The male conductive probe is attached, such as by threading, to the male electrical connector (710). If the assembly includes a female electrical connector, a female sleeve and a finger contact assembly are attached, such as by threading, to the corresponding female electrical connector (712).

A number of implementations have been described. Nevertheless, it will be understood that various modifications may be made. The rigid conductive sleeve can be used to build a variety of electrical connectors. For example, particular implementations of the connector assembly may not include the outer conductive layer that serves as a ground shield. In addition, the outer conductive layer can be made of other materials, such as insulative materials. The insulative layer can partially cover the inner surface of the rigid conductive insert. The connector assembly can have different numbers and configurations of the female and male connectors. For example, the connector assembly can have an H-shape with two female and two male connectors, one female and three male connectors, one male and three female connectors, or all female or all male connectors. The central portion of the housing that connects the female and male connectors can have any shape, including a J-shape, an X-shape, a Y-shape, or an L-shape. The central portion of the housing can be flexible so that the housing can be bent into other shapes. The rigid conductive sleeve can be non-integral with the conductive body portion and can be connected in a variety of ways, such as by threading, soldering, or welding. The finger contact assembly and the probe can be connected by ways other than by threading, such as by soldering or welding, or by making these parts integral. Each male connector can be removably coupled to another type of female connector and each female connector can be removably coupled to another type of male connector. These and other implementations are within the scope of the following claims.

What is claimed is:

1. An electrical connector assembly that may be removably coupled to a second electrical connector assembly, the electrical connector assembly comprising:

an elastomeric insulative layer;

a rigid conductive sleeve disposed within the insulative layer such that one or both of the rigid conductive sleeve and the insulative layer have interior surfaces that define an opening;

a conductive contact disposed within the opening;

a conductive or semi-conductive exterior layer at least partially covering the insulative layer;

wherein:

the rigid conductive sleeve is configured to act as a voltage shield and the conductive or semi-conductive exterior layer is configured to act as a ground shield, and the rigid conductive sleeve provides a direct electrical connection between the conductive contact and a conductive member within the electrical connector assembly by physically isolating the conductive contact and the conductive member from each other.

2. An electrical connector assembly that may be removably coupled to a second electrical connector assembly, the electrical connector assembly comprising:

an elastomeric insulative layer;

a one-piece rigid conductive sleeve disposed within the insulative layer, such that one or both of the rigid conductive sleeve and the insulative layer have interior surfaces that define an opening;

a conductive contact disposed within the opening; and a conductive or semi-conductive exterior layer at least partially covering the insulative layer, wherein the rigid conductive sleeve is configured to act as a voltage shield and the conductive or semi-conductive exterior layer is configured to act as a ground shield, wherein the insulative layer covers at least a portion of an interior surface of the rigid conductive sleeve, and wherein the rigid conductive sleeve provides a direct electrical connection between the conductive contact and a conductive member within the electrical connector assembly by physically isolating the conductive contact and the conductive member from each other.

3. The electrical connector assembly of claim 2 wherein the rigid conductive sleeve comprises a conductive metal or plastic.

4. The electrical connector assembly of claim 2 wherein the rigid conductive sleeve is electrically coupled to the conductive contact.

5. The electrical connector assembly of claim 2 wherein the conductive contact comprises a conductive probe configured to be received in a second conductive contact of the second electrical connector assembly.

6. The electrical connector assembly of claim 5 wherein the opening is configured to receive the second connector assembly while the conductive probe is received in the conductive sleeve of the second connector assembly.

7. The electrical connector assembly of claim 2 wherein the rigid conductive sleeve is configured to provide mechanical strength between the conductive contact and a second conductive contact of the second electrical connector assembly.

8. The electrical connector assembly of claim 2 wherein the rigid conductive sleeve is configured to act as a voltage shield around an electrical connection between the conductive contact and a second conductive contact of the second electrical connector assembly.

9. An electrical connector assembly comprising a housing having a first end portion with a first electrical connector and a second end portion with a second electrical connector, wherein:

the first electrical connector is configured to be removably coupled to a third electrical connector and comprises:

a first elastomeric insulative layer;

a first one-piece rigid conductive sleeve disposed within the first insulative layer, such that one or both of the first rigid conductive sleeve and the first insulative layer have interior surfaces that define a first opening;

a first conductive contact disposed within the first opening; and a first conductive or semi-conductive exterior layer at least partially covering the first insulative layer, wherein the first rigid conductive sleeve is configured to act as a voltage shield and the first conductive or semi-conductive exterior layer is configured to act as a ground shield;

wherein the second electrical connector is configured to be removably coupled to a fourth electrical connector; and wherein the first elastomeric insulative layer covers at least a portion of an interior surface of the first one-piece rigid conductive sleeve; and wherein the first rigid conductive sleeve provides a direct electrical connection between the first conductive contact and a conductive member within the electrical connector assembly by physically isolating the first conductive contact and the conductive member from each other.

10. The electrical connector assembly of claim 9 wherein the first conductive contact comprises a first conductive probe that is configured to be received in a third conductive contact of the third connector.

11. The electrical connector assembly of claim 10 wherein the first opening is configured to receive the third electrical connector while the first conductive probe is received in the third conductive contact.

12. The electrical connector assembly of claim 11 wherein the second electrical connector comprises a second conductive contact configured to receive a conductive probe of the fourth electrical connector.

13. The electrical connector assembly of claim 11 wherein the second electrical connector comprises:

a second elastomeric insulative layer;

a second rigid conductive sleeve disposed within the second insulative layer, such that one or both of the second rigid conductive sleeve and the second insulative layer have interior surfaces that define a second opening;

a second conductive contact disposed within the second opening; and a second conductive or semi-conductive exterior layer at least partially covering the second insulative layer, wherein the second rigid conductive sleeve is configured to act as a voltage shield and the second conductive or semi-conductive exterior layer is configured to act as a ground shield.

14. An electrical connector assembly comprising:

an elastomeric insulative layer;

a rigid conductive sleeve comprising only a rigid material and disposed within the elastomeric insulative layer such that one or both of the rigid conductive sleeve and the elastomeric insulative layer have interior surfaces that define an opening for receiving an electrical connector;

a conductive contact disposed within the opening and sized to mate with the electrical connector; and a conductive or semi-conductive exterior layer that at least partially covers the elastomeric insulative layer;

wherein the rigid conductive sleeve is configured to act as a voltage shield and the conductive or semi-conductive exterior layer is configured to act as a ground shield;

wherein the insulative layer covers at least a portion of an interior surface of the rigid conductive sleeve; and wherein the rigid conductive sleeve provides a direct electrical connection between the conductive contact and a conductive member within the electrical connector assembly by physically isolating the conductive contact and the conductive member from each other.

15. The electrical connector assembly of claim 14, wherein the rigid conductive sleeve makes direct and intimate contact with the conductive contact.

16. An electrical connector assembly comprising:

an elastomeric insulative layer;

a rigid conductive body including one or more rigid conductive sleeves and being disposed within the elastomeric insulative layer such that one or both of the rigid conductive sleeves and the elastomeric insulative layer have interior surfaces that define a first opening for receiving a first separable electrical connector;

a first conductive contact disposed within the first opening and sized to mate with the first separable electrical connector;

a conductive or semi-conductive exterior layer that at least partially covers the elastomeric insulative layer; and a second conductive contact within the elastomeric insulative layer and defining a second opening that is sized to mate with a second separable electrical connector;

wherein the one or more rigid conductive sleeves are configured to act as voltage shields and the conductive or semi-conductive exterior layer is configured to act as a ground shield;

wherein the rigid conductive body provides the primary conductive path between the first conductive contact and the second conductive contact; and wherein at least one of the rigid conductive sleeves provides a direct electrical connection between the first conductive contact and a conductive member within the electrical connector assembly by physically isolating the conductive contact and the conductive member from each other.

17. The electrical connector assembly of claim 16, wherein the conductive member includes a conductive bar in contact with the one or more rigid conductive sleeves.

18. The electrical connector assembly of claim 16, wherein the first conductive contact includes a conductive probe.

19. The electrical connector assembly of claim 16, wherein the second conductive contact includes a female contact.

20. The electrical connector assembly of claim 16, wherein the second conductive contact includes a conductive probe.

* * * * *